US007704664B2

(12) United States Patent
Matsumoto et al.

(10) Patent No.: US 7,704,664 B2
(45) **Date of Patent: *Apr. 27, 2010**

(54) METHOD OF MANUFACTURING TONER AND TONER

(75) Inventors: Katsuru Matsumoto, Nara (JP); Yasuhiro Shibai, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 503 days.

This patent is subject to a terminal disclaimer.

(21) Appl. No.: 11/705,468

(22) Filed: Feb. 13, 2007

(65) Prior Publication Data

US 2007/0196754 A1 Aug. 23, 2007

(30) Foreign Application Priority Data

Feb. 20, 2006 (JP) ..... P2006-043072

(51) Int. Cl.
*G03G 9/08* (2006.01)

(52) U.S. Cl. ..... 430/137.14; 430/108.1; 430/105

(58) Field of Classification Search ..... 430/137.14, 430/108.1, 105
See application file for complete search history.

(56) References Cited

U.S. PATENT DOCUMENTS

| | | | | |
|---|---|---|---|---|
| 5,424,162 | A | 6/1995 | Kohri et al. | |
| 5,514,636 | A | 5/1996 | Takeuchi | |
| 5,935,751 | A | 8/1999 | Matsuoka et al. | |
| 5,994,020 | A | 11/1999 | Patel et al. | |
| 6,120,967 | A | 9/2000 | Hopper et al. | |
| 6,190,820 | B1 | 2/2001 | Patel et al. | |
| 6,503,680 | B1 * | 1/2003 | Chen et al. | 430/137.14 |
| 2002/0055050 | A1 | 5/2002 | Serizawa et al. | |
| 2005/0041523 | A1 | 2/2005 | Nakano | |
| 2005/0175923 | A1 | 8/2005 | Nakazawa et al. | |
| 2006/0263711 | A1 | 11/2006 | Yuasa et al. | |
| 2007/0196756 | A1 | 8/2007 | Shibai et al. | |

FOREIGN PATENT DOCUMENTS

| | | |
|---|---|---|
| JP | 06-161153 A | 6/1994 |
| JP | 09-277348 A | 10/1997 |

(Continued)

OTHER PUBLICATIONS

U.S. Office Action mailed Mar. 18, 2009 in corresponding U.S. Appl. No. 11/705,504.

(Continued)

*Primary Examiner*—Mark A Chapman
(74) *Attorney, Agent, or Firm*—Nixon & Vanderhye P.C.

(57) ABSTRACT

In a method of manufacturing a toner in which toner particles are obtained by mixing resin particles and at least a colorant with each other to be coagulated, and heating an obtained coagulated product, binder resin is granulated into fine particles by a granulating method including a coarse particle preparing step, a slurry preparing step, a pulverizing step, a cooling step, and a depressurizing step. Slurry containing coarse particles of binder resin obtained by way of the coarse particle preparing step and the slurry preparing step is made to pass under heat and pressure through a pressure-resistant nozzle whereby the coarse particles of binder resin are pulverized into resin particles. By providing the cooling step and the depressurizing step immediately after the pulverizing step, the resin particles are prevented from coarsening.

10 Claims, 1 Drawing Sheet

FOREIGN PATENT DOCUMENTS

| | | | |
|---|---|---|---|
| JP | 10-207116 | A | 8/1998 |
| JP | 10-301333 | | 11/1998 |
| JP | 11-2922 | A | 1/1999 |
| JP | 2001-228651 | | 8/2001 |
| JP | 2001-305797 | | 11/2001 |
| JP | 2004-189765 | | 7/2004 |
| JP | 2005-31222 | A | 2/2005 |
| JP | 2005-165039 | | 6/2005 |
| WO | WO 03/005497 | | 7/2003 |
| WO | WO 03/059497 | | 7/2003 |

OTHER PUBLICATIONS

CN 1652033 A, Published Aug. 10, 2005 with English Abstract (corresponds to above cited U.S. Patent Application No. US 2005/0175923 A1, published Aug. 11, 2005).

JP 2002-72534 (Mar. 2002) published priority U.S. Appl. No. 2002/0055050.

JP 2002-108018 (Apr. 2002) published priority U.S. Appl. No. 2002/0055050.

* cited by examiner

METHOD OF MANUFACTURING TONER AND TONER

CROSS-REFERENCE TO RELATED APPLICATION

This application claims priority to Japanese Patent Application No. JP 2006-43072, which was filed on Feb. 20, 2006, the contents of which, are incorporated herein by reference, in their entirety.

BACKGROUND OF THE INVENTION

1. Field of the Invention

The present invention relates to a method of manufacturing a toner, as well as a toner.

2. Description of the Related Art

An electrophotographic image forming apparatus comprises an image forming process mechanism including: a photoreceptor; a charging section for charging a photoreceptor surface; an exposing section for irradiating with signal light the photoreceptor surface being charged, to form thereon an electrostatic latent image corresponding to image information; a developing section for supplying a toner contained in a developer to the electrostatic latent image formed on the photoreceptor surface, to form thereon a toner image; a transfer section provided with a transfer roller for transferring the toner image from the photoreceptor surface to a recording medium; a fixing section provided with a fixing roller for fixing the toner image onto the recording medium; and a cleaning section for cleaning the photoreceptor surface from which the toner image has been transferred. In the electrophotographic image forming apparatus, an image is formed by developing the electrostatic latent image by use of a one-component developer containing a toner or a two-component developer containing toner and carrier as a developer.

Through the electrophotographic image forming apparatus, an image of favorable image quality can be formed at high speed and low cost. This promotes the use of the electrophotographic image forming apparatus in a copier, a printer, a facsimile, or the like machine, resulting in a remarkable spread thereof in recent years. Simultaneously, the image forming apparatus has faced up to more demanding requirements. Among such requirements, particular attentions are directed to enhancement in definition and resolution, stabilization of image quality, and an increase in image forming speed, regarding an image being formed by the image forming apparatus. In order to fulfill these demands, a two-way approach is indispensable in view of both the image forming process and the developer. Regarding the enhancement in definition and resolution of the image, the reduction in diameter of toner particles is one of problems to be solved from the aspect of the developer. This is based on the perspective such that it is important to authentically reproduce the electrostatic latent image. As a method for obtaining a diameter-reduced toner, there has been developed a wet method in which a toner is manufactured in an organic solvent, water, or a combined solvent of organic solvent and water. A toner manufactured by the wet method is referred to as a chemical toner. Among the wet methods, a favorable method for obtaining a diameter-reduced toner exhibiting a narrow particle size distribution is an emulsification coagulation method in which resin particles and particles of other toner raw materials are coagulated and thus-obtained coagulated product is heated to manufacture a toner (refer to Japanese Unexamined Patent Publication JP-A 2001-228651, for example). However, resin represented by polyester, which is excellent in low-temperature fixing property and transparency and which is widely used as binder resin for toner, is hard to be granulated into fine particles. In order to granulate such resin into fine particles, it is necessary to use a detrimental organic solvent or a large amount of surfactant. The use of detrimental organic solvent should be avoided in consideration of environmental preservation, safety of operator, and the like. Further, the use of a large amount of surfactant makes it difficult to remove the surfactant after the manufacture of toner. Accordingly, in order to manufacture a diameter-reduced toner using polyester as binder resin by the emulsification coagulation method, polyester needs to be granulated into fine particles at the outset.

As a method of granulating the binder resin used for a toner into fine particles, there has been proposed a method including: a heating step of heating resin to a temperature of 100° C. or more at which a viscosity of the resin falls in an emulsifiable area of 100 Pa·s or less; and an emulsifying step of producing fine molten particles of the resin by giving a shearing force to an admixture of the resin heated at the heating step and a water-based solvent (refer to Japanese Unexamined Patent Publication JP-A 2004-189765, for example). According to an example of JP-A 2004-189765, there is obtained a water-based emulsion containing polyester particles of which volumetric average particle diameter is 1 μm or 800 nm. However, this is just a result obtained in a laboratory. If the method of JP-A 2004-189765 is applied to an industrial production of larger scale, it is very difficult to obtain a toner having a volumetric average particle diameter of 1 μm or less. Moreover, the particle diameter of resin particle obtained by the method is the volumetric average particle diameter and therefore, in practice, resin particles having a particle diameter exceeding 1 μm are contained. In the case where the resin particle having a particle diameter exceeding 1 μm is contained, a toner having a particle diameter exceeding 6.5 μm may possibly be generated in manufacture of toner according to the emulsification coagulation method.

Meanwhile, there has been proposed an emulsifying/dispersing apparatus comprising: an emulsifying/dispersing section for emulsifying/dispersing in a liquid serving as a matrix an emulsifying material which is granulated into fine particles; a leading passage for supplying a later-described multistage depressurization section with the pressurized emulsified liquid obtained by the emulsifying/dispersing section; a heat exchanging section disposed on the leading passage; and a multistage depressurization section for allowing the emulsified liquid supplied from the leading passage to have a reduced pressure causing no bubbling even if it is released to atmosphere, and then discharging the emulsified liquid (refer to International Publication WO03/059497, for example). In the emulsifying/dispersing apparatus, the emulsifying material is dispersed in a liquid under pressure, thereby preparing the emulsified liquid in which the emulsifying material is evenly dispersed. Next, the pressure on the emulsified liquid is reduced in a stepwise manner so that the final pressure is at a level causing no bubbling. By so doing, particles of the emulsifying material dispersed in the emulsified liquid are prevented from coarsening. The emulsifying/dispersing apparatus thus aims to obtain an emulsified liquid in which particles of emulsifying material having a uniform particle diameter are dispersed. By use of this emulsifying/dispersing apparatus which has the multistage depressurization section, a large shearing force can be given by the emulsifying/dispersing section, so that an emulsion of water/oil, for example, can be easily manufactured. However, on attempts to obtain a toner particle by use of this apparatus only, it is difficult to control the particle diameter, so that a desired toner particle with a reduced diameter cannot be obtained. Further, WO03/059497 has no disclosure about application of this emulsifying/dispersing apparatus to a manufacture of toner particles.

SUMMARY OF THE INVENTION

An object of the invention is to provide a toner which is excellent in image reproducibility and capable of forming a high-definition and high-resolution image of high quality, and which is excellent in low-temperature fixing property and transparency, as well as a manufacturing method of the toner.

The inventors have devised the invention through keen studies for solving the above problems. As a result of the studies, it turned out that a desired toner can be obtained not by merely giving a shearing force to water-based slurry which contains coarse particles containing at least binder resin but by letting the water-based slurry under heat and pressure pass through a pressure-resistant nozzle to thereby pulverize the coarse particles of binder resin and then cooling down thus-obtained water-based slurry, followed by stepwise depressurization to obtain resin particles having a reduced diameter, which are then coagulated together with other toner components such as a colorant.

The invention provides a method of manufacturing a toner comprising the steps of:

coagulating resin particles containing at least binder resin, which have a particle diameter of 1 μm or less and are obtained from slurry containing coarse particles of binder resin by a high pressure homogenizer method, and particles of toner raw material not contained in the resin particles; and heating a resultant coagulated product.

Further, in the invention, it is preferable that a particle diameter of the resin particles containing at least binder resin falls in a range of 30 nm to 1000 nm.

According to the invention, resin particles having a particle diameter of 1 μm or less (preferably in a range of 30 nm to 1000 nm) are used which contain at least binder resin and are obtained from slurry containing coarse particles of binder resin by a high pressure homogenizer method, and the resin particles as described and the particles of toner raw material not contained in the resin particles are coagulated, the resultant coagulated product being then heated, to thereby obtain a diameter-reduced toner having a particle diameter of around 3.5 μm to 6.5 μm. The diameter-reduced toner exhibits a narrow particle size distribution and its particles are uniform in shape. The diameter-reduced toner is thus excellent in reproducibility of an original image and capable of forming a high-definition and high-resolution image of high quality, and moreover excellent in low-temperature fixing property, transparency, and the like. The use of the toner in performing the image formation allows enhancement in transfer efficiencies of the toner image which is transferred from a photoreceptor to a recording medium, from the photoreceptor to an intermediate medium, and from the intermediate medium to the recording medium, with the result that the reduction of toner consumption can be achieved.

Further, in the invention, it is preferable that the high pressure homogenizer method comprises:

a pulverizing step for obtaining heated and pressurized slurry containing resin particles having a particle diameter of 1 μm or less by passing slurry containing coarse particles of binder resin through a pressure-resistant nozzle under heat and pressure and pulverizing the coarse particles of binder resin;

a cooling step for cooling down the slurry obtained at the pulverizing step; and a depressurizing step for gradually depressurizing the slurry cooled down at the cooling step, to a pressure level at which no bubbling is caused.

According to the invention, it is preferred to use resin particles obtained by the high pressure homogenizer method including a pulverizing step, a cooling step, and a depressurizing step. According to the high pressure homogenizer method, it is possible to easily obtain fine resin particles of which particle diameter is 1 μm or less, preferably in a range of 30 nm to 1000 nm. This is because the slurry containing coarse particles of binder resin is made to pass under heat and pressure through a pressure-resistant nozzle so that the coarse particles of binder resin are pulverized, thus preparing slurry of binder resin and then cooling down the slurry at the cooling step provided immediately after the pulverization, followed by depressurization of the slurry at the depressurizing step to a pressure level at which no generation of bubbles (bubbling) is caused. By so doing, the bubbling and thus coarsening of toner particles in the slurry are prevented.

Further, in the invention, it is preferable that the slurry containing coarse particles of binder resin is slurry prepared by dispersing the coarse particles of binder resin into water.

According to the invention, water is used as a liquid for preparing the slurry containing coarse particles of binder resin, in a consequence whereof controls over the following steps can be simplified and moreover, a waste liquid can be easily disposed after the manufacture of the resin particles. The use of water thus leads enhancement in productivity of the resin particles, therefore contributing to cost reduction.

Further, in the invention, it is preferable that the slurry containing coarse particles of binder resin is slurry prepared by dispersing the coarse particles of binder resin into an admixture of water and a dispersion stabilizer.

According to the invention, water containing a dispersion stabilizer is used as a liquid for preparing the coarse particles of binder resin, in a consequence whereof the coarsening of the resin particles due to bubbling is notably prevented at the respective steps, thus achieving further reduction in diameter of the resin particles finally obtained, further equalization of the diameter of the resin particles, and further simplification of the controls over the steps.

Further, in the invention, it is preferable that the slurry is pressurized at a pressure in a range from 50 MPa to 250 MPa, and heated to 50° C. or more at the pulverizing step.

Further, in the invention, it is preferable that the slurry is pressurized at a pressure in a range from 50 MPa to 250 MPa, and heated to 90° C. or more at the pulverizing step.

According to the invention, the slurry is pressurized to 50 MPa or more and 250 MPa or less and heated to 50° C. or more (preferably 90° C. or more) at the pulverizing step, in a consequence whereof bubble generation is absolutely smaller than a level at which the particle diameter of the resin particles is affected by the bubbles, thus further facilitating the control over the particle diameter of the resin particles and the reduction of the particle diameter of the resin particles. This makes it possible to manufacture the resin particles in high yield, of which particle diameter is uniform and small.

Further, in the invention, it is preferable that the pressure-resistant nozzle is a multiple nozzle.

According to the invention, the multiple nozzle is used as the pressure-resistant nozzle, in a consequence whereof the resin particles can be stably reduced in size and moreover, it is possible to prevent the resin particles from undergoing coagulation and coarsening which are caused by mutual contact of the diameter-reduced resin particles.

Further, in the invention, it is preferable that at the depressurizing step, a pressure on the slurry is gradually reduced to a level at which no bubbling is caused by passing the pressurized slurry containing resin particles, which is cooled down at the cooling step, through a multistage depressurization apparatus for performing stepwise depressurization.

According to the invention, at the depressurizing step, the pressurized slurry containing resin particles, cooled down at the cooling step is made to pass through the multistage depressurization apparatus for performing stepwise depressurization, and the pressure on the slurry is gradually reduced to a level at which no bubbling is caused, in a consequence whereof the bubbling is further reliably prevented from being caused, thus obtaining a toner containing almost no coagulation of coarsened resin particles, which is formed by the influence of bubbles.

Further, in the invention, it is preferable that the multistage depressurization apparatus used at the depressurizing step comprises:

an inlet passage for leading the pressurized slurry containing resin particles into the depressurization apparatus;

an outlet passage in communication with the inlet passage, for discharging the slurry containing resin particles to outside of the depressurization apparatus; and a multistage depressurization section for performing stepwise depressurization, the multistage depressurization section being disposed between the inlet passage and the outlet passage and being composed of two or more depressurization members coupled via coupling members.

According to the invention, at the depressurizing step, there is used the multistage depressurization apparatus composed of: the inlet passage for leading the pressurized slurry containing resin particles after completion of the cooling step; the outlet passage in communication with the inlet passage, for discharging the depressurized slurry containing resin particles to outside; and the multistage depressurization section which is disposed between the inlet passage and the outlet passage, and is composed of two or more depressurization members coupled via the coupling members, in a consequence whereof the pressure on the pressurized slurry containing resin particles can be smoothly reduced to a level at which no bubbling is caused.

Further, in the invention, it is preferable that the binder resin is polyester.

According to the invention, the use of polyester as the binder resin leads further enhancement in low-temperature fixing property, transparency, and the like property of the diameter-reduced toner being obtained.

Further, the invention provides a toner manufactured by any one of the above methods of manufacturing a toner.

According to the invention, the toner obtained by the manufacturing method of the invention is provided. As described above, the toner has various advantages such that the toner is excellent in image reproducibility and hard to cause the toner filming on a photoreceptor and the offset phenomenon in a high temperature, a transfer efficiency of the toner is high, and a consumption of the toner for image formation per one sheet is smaller than that of a conventional toner.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
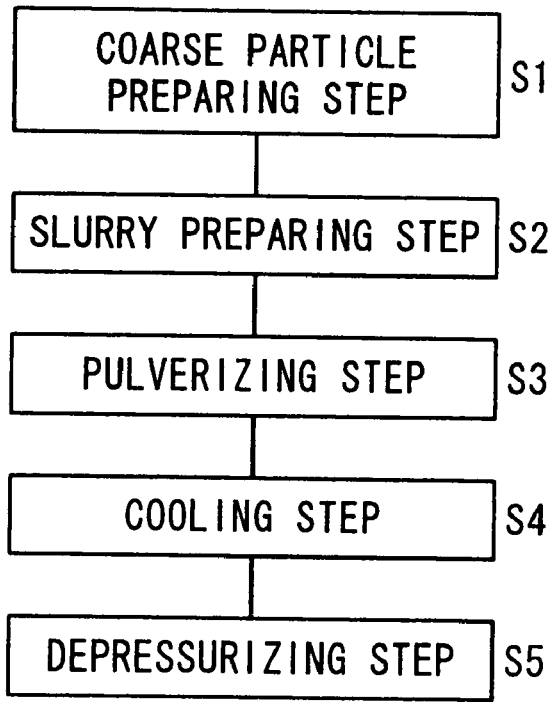
FIG. 1 is a flowchart showing a method of manufacturing a toner according to a first embodiment of the invention.

Now referring to the drawings, preferred embodiments of the invention are described below.

In the invention, resin particles and other toner components are mixed with each other to be then coagulated, whereby a toner is manufactured. That is to say, a manufacturing method of the invention includes a resin particle preparing process (A) and a toner manufacturing process (B).

(A) Resin Particle Preparing Process

Resin particles are prepared by a high-pressure homogenizer method. The resin particles may contain only binder resin, or alternatively, may contain, together with binder resin, one or two or more ingredients selected from a colorant, a releasing agent, and a charge control agent, which are toner raw materials except the binder resin. In a later section regarding the toner manufacturing method expressed with (B), further descriptions will be given to the colorant, the releasing agent, and the charge control agent. Herein, the high-pressure homogenizer method means a method in which synthetic resin or the like ingredient is reduced in particle size or granulated by use of a high-pressure homogenizer which is a device for pulverizing particles under pressure. Usable high-pressure homogenizer includes those available on the market or those described in patent publications. Examples of the commercially available high-pressure homogenizer include chamber-type high-pressure homogenizers such as Micofluidizer (trade name) manufactured by Microfluidics Corporation, Nanomizer (trade name) manufactured by Nanomizer Inc., and Ultimizer (trade name) manufactured by Sugino Machine Ltd., High-pressure homogenizer (trade name) manufactured by Rannie Inc., High-pressure homogenizer (trade name) manufactured by Sanmaru Machinery Co., Ltd., and High-pressure homogenizer (trade name) manufactured by Izumi Food Machinery Co., Ltd. Further, examples of the high-pressure homogenizer described in patent publications include a high-pressure homogenizer described in WO03/059497. Among the above homogenizers, preferred is the high-pressure homogenizer described in WO03/059497. One example of a method of manufacturing resin particles by use of the high-pressure homogenizer is shown in FIG. 1. FIG. 1 is a flowchart schematically showing a method of manufacturing resin particles. The manufacturing method shown in FIG. 1 includes a coarse particle preparing step S1, a slurry preparing step S2, a pulverizing step S3, a cooling step S4, and a depressurizing step S5. Among these steps, the high-pressure homogenizer method using the high-pressure homogenizer described in WO03/059497 corresponds to the pulverizing step S3, the cooling step S4, and the depressurizing step S5. Hereinafter, the method of manufacturing resin particles shown in FIG. 1 will be specifically described.

[Coarse Particle Preparing step S1]

At the coarse particle preparing step S1, binder resin is coarsely pulverized into coarse powders. As the binder resin, it is possible to use an ingredient commonly used in the electrophotographic field, which can be granulated in its molten state. Specific examples thereof include polyester, acrylic resin, polyurethane, and epoxy resin.

As polyester, heretofore known ingredients can be used, including a polycondensation of polybasic acid and polyhydric alcohol. As polybasic acid, those known as a monomer for polyester can be used, including: aromatic carboxylic acids such as terephthalic acid, isophthalic acid, phthalic acid anhydride, trimellitic acid anhydride, pyromellitic acid, and naphthalene dicarboxylic acid; aliphatic carboxylic acids such as maleic acid anhydride, fumaric acid, succinic acid, alkenyl succinic anhydride, and adipic acid; and a methyl-esterified compound of these polybasic acids. These polybasic acids may be used each alone or two or more of the polybasic acids may be used in combination. As polyhydric alcohol, those known as a monomer for polyester can also be used, including: aliphatic polyhydric alcohols such as ethylene glycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. These polyhydric alcohols may be used each alone or two or more of the polyhydric alcohols may be used in combination. Polycondensation reaction of polybasic acid and polyhydric alcohol can be effected in a common manner. For example, the polycondensation reaction is effected by contacting polybasic acid and polyhydric alcohol each other in the presence or absence of an organic solvent and under the presence of a polycondensation catalyst, and terminated at the instant when the acid value and the softening temperature of the resultant polyester stand at predetermined values. Polyester is thus obtained. In the case of using the methyl-esterified compound of polybasic acid as a part of polybasic acid, a de-methanol polycondensation reaction takes place. In the polycondensation reaction, by properly changing the blending ratio, the reaction rate, or other factors as to the polybasic acid and the polyhydric alcohol, it is possible to adjust, for example, the terminal carboxyl group content of polyester and thus denature a property of the resultant polyester. Further, in the case of using trimellitic anhydride as polybasic acid, the denatured polyester can be obtained also by facile introduction of a carboxyl group into a main chain of polyester.

As the acrylic resin, the selection of ingredients is not particularly limited, and acid group-containing acrylic resin can be preferably used. The acid group-containing acrylic resin can be produced, for example, by polymerization of acrylic resin monomers or polymerization of acrylic resin monomer and vinylic monomer with concurrent use of acidic group- or hydrophilic group-containing acrylic resin monomer and/or acidic group- or hydrophilic group-containing vinylic monomer. As the acrylic resin monomer, heretofore known ingredients can be used, including acrylic acid which may have a substituent, methacrylic acid which may have a substituent, acrylic acid ester which may have a substituent, and methacrylic acid ester which may have a substituent. The acrylic resin monomers may be used each alone or two or more of the acrylic resin monomers may be used in combination. Moreover, as the vinylic monomer, heretofore known ingredients can be used, including styrene, α-methylstyrene, vinyl bromide, vinyl chloride, vinyl acetate, acrylonitrile, and methacrylonitrile. These vinylic monomers may be used each alone or two or more of the vinylic monomers may be used in combination. The polymerization is effected by use of a commonly-used radical initiator in accordance with a solution polymerization method, a suspension polymerization method, an emulsification polymerization method, or the like method.

As the polyurethane, the selection of ingredients is not particularly limited, and acidic group- or basic group-containing polyurethane can be preferably used, for example. The acidic group- or basic group-containing polyurethane can be produced in accordance with a heretofore known method, for example, by subjecting acidic group- or basic group-containing diol, polyol, and polyisocyanate to an addition polymerization. Examples of the acidic group- or basic group-containing diol include dimethylol propionic acid and N-methyl diethanol amine. Examples of the polyol include polyether polyol such as polyethylene glycol, and polyester polyol, acryl polyol, and polybutadiene polyol. Examples of the polyisocyanate include tolylene diisocyanate, hexamethylene diisocyanate, and isophorone diisocyanate. These components may be used each alone or two or more of the components may be used in combination.

As the epoxy resin, the selection of ingredients is not particularly limited, and acidic group- or basic group-containing epoxy resin can be preferably used. The acidic group- or basic group-containing epoxy resin can be produced, for example, by addition or addition polymerization of polyvalent carboxylic acid such as adipic acid and trimellitic acid anhydride or amine such as dibutyl amine and ethylene diamine to epoxy resin which serves as a base.

Among these binder resins, polyester is preferred. Polyester is excellent in transparency and capable of providing the obtained toner particles with favorable powder flowability, low-temperature fixing property and secondary color reproducibility, thus being suitably used as binder resin for a color toner. Further, polyester and acrylic resin may also be used by grafting.

In the case where facilitation of granulating operation, a kneading property with the colorant, and equalization of shape and size of toner particles are taken into consideration, it is preferable to use binder resin having a softening temperature of 150° C. or lower, and particularly preferable to use binder resin having a softening temperature of from 60° C. to 150° C. Among such binder resins, preferred is binder resin of which weight-average molecular weight falls in a range of from 5,000 to 500,000.

The binder resins may be used each alone or two or more of the binder resins may be used in combination. Furthermore, it is possible to use a plurality of resins of the same type, which are different in any one or all of molecular weight, monomer composition, and other factors.

Note that, in a case of manufacturing a capsule toner according to the manufacturing method of the invention, binder resin intended for a core material and binder resin intended for forming an outer shell are used. These binder resins can be granulated separately or simultaneously.

As the binder resin intended for a core material, preferred is resin containing one or two or more monomers of styrenes, maleic acid monoesters, and fumaric acid monoesters. A content of the styrene monomer in binder resin is preferably 30% to 95% by weight and more preferably 40% to 95% by weight, based on a total amount of the monomers. A content of the monomer of maleic acid monoesters and/or fumaric acid monoesters is preferably 5% to 70% by weight and more preferably 5% to 50% by weight, based on a total amount of the monomers.

Examples of the styrene monomer contained in the binder resin intended for a core material include styrene, α-methyl styrene, styrene halide, vinyl toluene, 4-sulfonamide styrene, 4-styrene sulfonic acid, and divinylbenzene. Examples of the monomer of maleic acid monoesters include diethyl maleate, dipropyl maleate, dibutyl maleate, dipentyl maleate, dihexyl maleate, heptyl maleate, octyl maleate, ethylbutyl maleate, ethyloctyl maleate, butyloctyl maleate, butylhexyl maleate, and penetyloctyl maleate. Examples of the monomer of fumaric acid monoesters include diethyl fumarate, dipropyl fumarate, dibutyl fumarate, dipentyl fumarate, dihexyl fumarate, heptyl fumarate, octyl fumarate, ethylbutyl fumarate, ethyoctyl fumarate, butyloctyl fumarate, butylhexyl fumarate, and pentyloctyl fumarate.

Furthermore, in addition to the above-cited monomers, examples of the binder resin intended for a core material include a monomer of (meth)acrylic esters, a monomer of (meth)acrylamide alkyl sulfonic acids, a multifunctional (meth)acrylic monomer, and a monomer of peroxides.

Examples of the monomer of (meth)acrylic esters include methyl (meth)acrylate, ethyl (meth)acrylate, propyl (meth) acrylate, n-butyl (meth)acrylate, isobutyl (meth)acrylate, octyl (meth)acrylate, dodecyl (meth)acrylate, lauryl (meth) acrylate, stearyl (meth)acrylate, cyclohexyl (meth)acrylate, phenyl (meth)acrylate, benzyl (meth)acrylate, furfuryl (meth)acrylate, hydroxylethyl (meth)acrylate, hydroxybutyl (meth)acrylate, dimethylaminomethyl ester (meth)acrylate, dimethylaminoethyl ester (meth)acrylate, 2-ethylhexyl (meth)acrylate, and 2-chloroethyl (meth)acrylate.

Examples of the monomer of (meth)acrylamide alkyl sulfonic acids include acrylamidemethyl sulfonic acid, acrylamideethyl sulfonic acid, acrylamide n-propylsulfonic acid, acrylamide isopropylsulfonic acid, acrylamide n-butylsulfonic acid, acrylamide s-butylsulfonic acid, acrylamide t-butylsulfonic acid, acrylamide pentanesulfonic acid, acrylamide hexanesulfonic acid, acrylamide heptanesulfonic acid, acrylamide octanesulfonic acid, methacrylamide methylsulfonic acid, methacrylamide ethylsulfonic acid, methacrylamide n-propylsulfonic acid, methacrylamide isopropylsulfonic acid, methacrylamide n-butylsulfonic acid, methacrylamide s-butylsulfonic acid, methacrylamide t-butylsulfonic acid, methacrylamide pentanesulfonic acid, methacrylamide hexanesulfonic acid, methacrylamide heptanesulfonic acid, and methacrylamide octanesulfonic acid.

Examples of the multifunctional (meth)acrylic monomer include 1,3-butyleneglycol diacrylate, 1,5-pentanediol diacrylate, neopentylglycol diacrylate, 1,6-hexanediol diacrylate, diethyleneglycol diacrylate, triethyleneglycol diacrylate, tetraethyleneglycol diacrylate, polyethyleneglycol diacrylate, polyethyleneglycol #400 diacrylate, polyethylene glycol #600 diacrylate, polypropylene diacrylate, N,N'-methylene bisacrylamide, pentaerythritol triacrylate, trimethylolpropane triacrylate, tetramethylolpropane triacrylate, 1,4-butanediol diacrylate, diethyleneglycol dimethacrylate, 1,3-butyleneglycol dimethacrylate, 1,5-pentanediol dimethacrylate, neopentylglycol dimethacrylate, 1,6-hexanediol dimethacrylate, diethyleneglycol dimethacrylate, triethyleneglycol dimethacrylate, tetraethyleneglycol dimethacrylate, polyethyleneglycol dimethacrylate, polyethyleneglycol #400 dimethacrylate, polyethyleneglycol #600 dimethacrylate, polypropylene dimethacrylate, N,N'-methylene bismethacrylamide, pentaerythritol trimethacrylate, trimethylolpropane trimethacrylate, tetramethylolpropane trimethacrylate, 1,4-butanediol dimethacrylate, 2,2-bis(4-methacryloxy polyethoxyphenyl)propane, aluminum methacrylate, calcium methacrylate, zinc methacrylate, and magnesium methacrylate.

Examples of the monomer of peroxides include t-butylperoxy methacrylate, t-butylperoxy crotonate, di(t-butylperoxy)fumarate, t-butylperoxy allylcarbonate, pertrimellitic acid tri-t-butyl ester, pertrimellitic acid tri-t-aminoester, pertrimellitic acid tri-t-hexyl ester, pertrimellitic acid tri-t-1,1,3,3-tetramethyl butyl ester, pertrimellitic acid tri-t-cumyl ester, pertrimellitic acid tri-t-(p-isopropyl)cumyl ester, pertrimesic acid tri-t-butyl ester, pertrimesic acid tri-t-amino ester, pertrimesic acid tri-t-hexyl ester, pertrimesic acid tri-t-1,1,3,3-tetramethyl butyl ester, pertrimesic acid tri-t-cumyl ester, pertrimesic acid tri-t-(p-isopropyl)cumyl ester, 2,2-bis(4,4-di-t-butylperoxycyclohexyl)propane, 2,2-bis(4,4-di-t-hexylperoxycyclohexyl)propane, 2,2-bis(4,4-di-t-amylperoxycyclohexyl)propane, 2,2-bis(4,4-di-t-octylperoxycyclohexyl)propane, 2,2-bis(4,4-di-α-cumylperoxycyclohexyl)propane, 2,2-bis(4,4-di-t-butylperoxycyclohexyl)butane, and 2,2-bis(4,4-di-t-octylperoxycyclohexyl)butane.

It is preferred that the binder resin intended for a core material be formed by two-stage polymerization of one or two or more of the above monomers. The two-stage polymerization can be effected by a solution polymerization method, a suspension polymerization method, an emulsification polymerization method, and the like method, among which the solution polymerization method is preferable. A molecular weight distribution curve of binder resin obtained by the two-stage polymerization shows at least two peaks, that is, at least one in a low-molecular range and one in a high-molecular range.

The core material may contain, as well as the above binder resin, styrene-acrylic resin, polyurethane, styrene-butadiene resin, polyester, and epoxy, for example.

Meanwhile, the outer shell is formed of thermoplastic resin which includes a vinylic polymer, polyester, epoxy resin, and polyurethane. Among these ingredients, the vinylic polymer and polyester are preferred. To be more specific, a styrene-n-butylacrylate copolymer, a styrene-methylmethacrylate-n-butylmethacrylate copolymer, and a condensation product of terephthalate-bisphenol A propylene oxide can be cited.

The melt-kneaded product of binder resin can be produced, for example, by melt-kneading the binder resin under heat at a temperature (usually about 80° C. to 200° C., preferably about 100° C. to 150° C.) which is equal to or higher than the melting temperature of the binder resin. For melt-kneading, it is possible to use commonly-used kneading machines such as a twin-screw extruder, three rolls, and laboplast mill. To be more specific, usable kneading machines include single or twine screw extruders such as TEM-100B (trade name) manufactured by Toshiba Kikai Co. and PCM-65/87 (trade name) manufactured by Ikegai Co., and open roll systems such as Kneadics (trade name) manufactured by Mitsui Mining Co. The melt-kneaded product of binder resin is cooled down to be solidified. Note that the melt-kneaded product of binder resin may contain one or two or more of a colorant, a releasing agent, and a charge control agent, which are toner raw materials except the binder resin.

The cooled and solidified product obtained from the melt-kneaded product is coarsely pulverized by use of a particle pulverizer such as a cutter mill, a feather mill, and a jet mill so that coarse powders of the binder resin are obtained. A particle diameter of the coarse powders is not limited to a particular size, and set to be preferably 450 μm to 1000 μm, and more preferably around 500 μm to 800 μm.

[Slurry Preparing Step S2]

At the slurry preparing step S2, the coarse powders of binder resin (hereinafter referred to as "binder resin coarse particles") which are obtained at the coarse particle preparing step, is mixed with a liquid so that the binder resin coarse particles are dispersed in the liquid, whereby slurry of the binder resin coarse particles is prepared.

The liquid being mixed with the binder resin coarse particles is not limited to a particular liquid as long as the liquid allows the binder resin coarse particles to be not dissolved therein but evenly dispersed therein. In view of ease of the controls over the steps and the waste liquid disposal after completion of all the steps, water is preferably selected as the liquid, and more preferable is water containing a dispersion stabilizer. The dispersion stabilizer has been preferably added to water in advance before the binder resin coarse particles are added to the water. An addition amount of the dispersion stabilizer is not limited to a particular amount, and the addition amount is preferably 0.05% to 10% by weight and more preferably 0.1% to 3% by weight of a total amount of the water and dispersion stabilizer.

As the dispersion stabilizer, the selection of ingredients is not particularly limited, and it is possible to use ingredients commonly used in this field, among which a water-soluble polymeric dispersant is preferable. Examples of the water-soluble polymeric dispersant include: polyoxyethylene polymers such as (meth)acrylic polymer, polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenylester, and polyoxyethylene nonylphenylester; cellulose polymers such as methylcellulose, hydroxyethylcellulose, and hydroxypropylcellulose; polyoxyalkylene alkylarylether sulfate salts such as sodium polyoxyethylene laurylphenylether sulfate, potassium polyoxyethylene laurylphenylether sulfate, sodium polyoxyethylene nonylphenylether sulfate, sodium polyoxyethylene oleylphenylether sulfate, sodium polyoxyethylene cetylphenylether sulfate, ammonium polyoxyethylene laurylphenylether sulfate, ammonium polyoxyethylene nonylphenylether sulfate, and ammonium polyoxyethylene oleylphenylether sulfate; and pqlyoxyalkylene alkylether sulfate salts such as sodium polyoxyethylene laurylether sulfate, potassium polyoxyethylene laurylether sulfate, sodium polyoxyethylene oleylether sulfate, sodium polyoxyethylene cetylether sulfate, ammonium polyoxyethylene laurylether sulfate, and ammonium polyoxyethylene oleylether sulfate, which contains one or two hydrophilic monomers selected from: acrylic monomers such as (meth)acrylic acid, α-cyanoacrylate, α-cyanomethacrylate, itaconic acid, crotonic acid, fumaric acid, maleic acid, and maleic acid anhydride; hydroxyl-containing acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, and 3-chloro-2-hydroxypropyl methacrylate; ester monomers such as diethylene glycol monoacrylic ester, diethylene glycol monomethacrylic ester, glycerine monoacrylic ester, and glycerine monomethacrylic ester; vinyl alcohol monomers such as N-methylol acrylamide and N-methylol methacrylamide; vinylalkylether monomers such as vinylmethylether, vinylethylether, and vinylpropylether; vinylalkylester monomers such as vinyl acetate, vinyl propionate, and vinyl butyrate; aromatic vinyl monomers such as styrene, α-methylstyrene, and vinyl toluene; amide monomers such as acrylamide, methacrylamide, diacetone acrylamide, and methylol compounds thereof; nitrile monomers such as acrylonitrile and methacrylonitorile; acid chloride monomers such as chloride acrylate and chloride methacrylate; vinyl nitrogen-containing heterocyclic monomers such as vinylpyridine, vinylpyrrolidone, vinylimidazole, and ethyleneimine; and cross-linking monomers such as ethyleneglycol dimethacrylate, diethyleneglycol dimethacrylate, allyl methacrylate, and divinylbenzene. The dispersion stabilizers may be used each alone or two or more dispersion stabilizers may be used in combination.

Further, in manufacturing the capsule toner, it is preferred that the dispersion stabilizer and methanol be added together with toner components to the slurry of resin particles. The dispersion stabilizer and an addition amount thereof are as referred to above. Further, an addition amount of methanol is not limited to a particular amount, and the addition amount of methanol is preferably 1% to 5% by weight of a total amount of the water and methanol. As in the case of the water-soluble polymeric dispersion stabilizer, methanol has been also preferably added to water in advance before the binder resin coarse particles are added to the water.

The mixing of the binder resin coarse particles and the liquid is conducted by use of a commonly-used mixer so that slurry of the binder resin coarse particles is obtained. An addition amount of the binder resin coarse particles relative to the liquid is not limited to a particular amount, and the amount of the binder resin coarse particles is preferably 3% to 45% by weight and more preferably 5% to 30% by weight of a total amount of the toner coarse particles and liquid. Furthermore, the mixing of the binder resin coarse particles and water may be conducted under heating or cooling though usually conducted at a room temperature. Examples of the mixer include Henschel-type mixing apparatuses such as a Henschel mixer (trade name) manufactured by Mitsui Mining Co., a super mixer (trade name) manufactured by Kawata Co., and a MECHANO mill (trade name) manufactured by Okada Seiko Co., ONGU mill (trade name) manufactured by Hosokawa Micron Co., Hybridization system (trade name) manufactured by Nara Kikai Seisakusho Co., and Cosmo system (trade name) manufactured by Kawasaki Heavy Industry Co.

The slurry of binder resin coarse particles thus obtained may be directly subjected to a process at the pulverizing step S3, or alternatively, may be subjected to a commonly-used coarse particle pulverizing process, for example, as a pretreatment, such as pulverizing the binder resin coarse particles to have a particle diameter of preferably around 100 μm, and more preferably 100 μm or less. The coarse particle pulverizing process is performed, for example, by letting the slurry of binder resin coarse particles pass under high pressure through a nozzle.

[Pulverizing Step S3]

At the pulverizing step S3, the slurry of binder resin coarse particles obtained at the slurry preparing step S2 is made to pass under heat and pressure through a pressure-resistant nozzle, whereby the binder resin coarse particles are pulverized into resin particles, resulting in slurry of resin particles.

A pressurizing and heating condition for the slurry of binder resin coarse particles is not limited to a particular condition. The slurry is preferably pressurized at 50 MPa to 250 MPa and heated to be 50° C. or more, and more preferably pressurized at 50 MPa to 250 MPa and heated to be 90° C. or more, and furthermore preferably pressurized at 50 MPa to 250 MPa and heated to be a temperature between 90° C. and (Tm+25)° C. wherein Tm represents a half softening temperature (° C.) measured by a flow tester. Pressure below 50 MPa causes the shearing energy to be small, which possibly leads insufficient reduction of the particle diameter. Pressure above 250 MPa excessively increases a degree of risk in an actual production line, thus being unrealistic. The slurry of toner coarse particles is lead at a pressure and temperature falling in the above-stated ranges, from the inlet of the pressure-resistant nozzle into the pressure-resistant nozzle.

As the pressure-resistant nozzle, it is possible to use a commonly-used pressure-resistant nozzle through which a liquid can flow. A preferably-used pressure-resistant nozzle is, for example, a multiple nozzle having a plurality of liquid flowing passages. The liquid flowing passages of the multiple nozzle may be arranged in form of a concentric circle of which center is a shaft of the multiple nozzle. Alternatively, the liquid flowing passages may be arranged in substantially parallel with a longitudinal direction of the multiple nozzle. One example of the multiple nozzle being used in the manufacturing method of the invention is a nozzle having one or a plurality of liquid flowing passages, preferably having around one or two liquid passages, each of which is around 0.05 mm to 0.35 mm in inlet diameter and outlet diameter and 0.5 cm to 5 cm in length.

Figure 2:
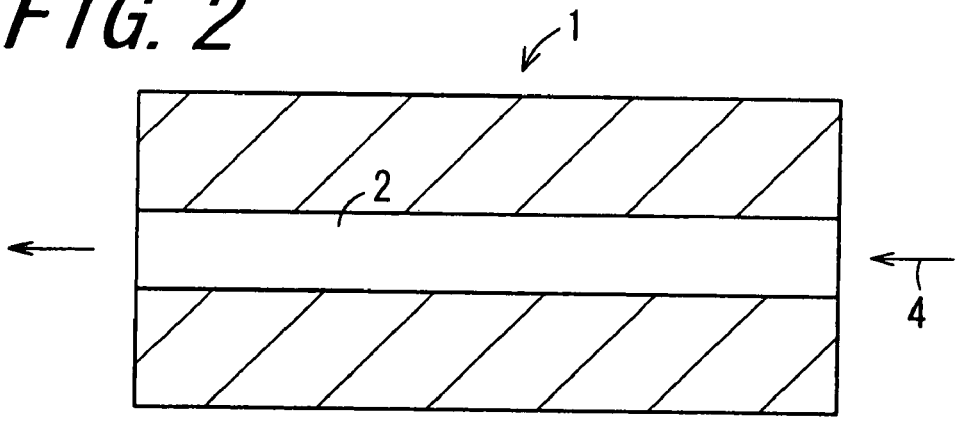
FIG. 2 is a sectional view schematically showing a configuration of a pressure-resistant nozzle.

A pressure-resistant nozzle shown in FIG. 2 is usable. FIG. 2 is a sectional view schematically showing a configuration of a pressure-resistant nozzle 1. The pressure-resistant nozzle 1 has a liquid flowing passage 2 therein, which extends linearly. The slurry containing binder resin coarse particles flows in a direction of an arrow 4 into the liquid flowing passage 2. The slurry containing binder resin coarse particles thus flows through the liquid flowing passage 2, whereby the binder resin coarse particles are pulverized into smaller binder resin particles which are then discharged from the pressure-resistant nozzle 1. In the pressure-resistant nozzle 1, an inlet and an outlet are formed so as be the same in diameter. The inlet and outlet are, however, not limited to such a configuration, and may be formed so that the outlet is smaller than the inlet in diameter.

The slurry discharged from the outlet of the pressure-resistant nozzle contains resin particles having a reduced diameter around 30 nm to 1000 nm, for example. The slurry is heated to be a temperature between 60° C. and (Tm+60)° C. (Tm is the same as the above-mentioned; section is ° C.), and pressurized at around 10 MPa to 50 MPa.

The number of the pressure-resistant nozzle being disposed may be one or plural.

[Cooling Step S4]

At the cooling step S4, the heated and pressurized slurry containing diameter-reduced resin particles obtained at the pulverizing step S3 is cooled down. At the cooling step S4, the diameter-reduced resin particle-containing slurry discharged from the pressure-resistant nozzle at the previous step is cooled down. A cooling temperature is not limited. As an indication, when the slurry is cooled down to a liquid temperature of 30° C. or lower, for example, pressure imparted to the slurry is reduced to a level around 5 MPa to 80 MPa.

For the cooling, it is possible to use any of commonly-used liquid cooling machines having a pressure-resistant structure. Among such cooling machines, preferred is a cooling machine having a large cooling area, such as a corrugated tube-type cooling machine. Further, the cooling machine is preferably configured so that a cooling gradient (or cooling capacity) is smaller from an inlet to an outlet of the cooling machine. This is because such a configuration contributes to more effective achievements of reduction in diameter of the resin particles. Further, coarsening of the resin particles, which is caused by mutual reattachment of the toner particles, is prevented, allowing enhancement in yield of the diameter-reduced resin particles.

The diameter-reduced resin particle-containing slurry discharged from the pressure-resistant nozzle at the previous step is, for example, lead from the inlet of the cooling machine into the cooling machine, and then subjected to the cooling inside the cooling machine having a cooling gradient, followed by being discharged from the outlet of the cooling machine. The number of the cooling machine being disposed may be one or plural.

[Depressurizing Step S5]

At the depressurizing step S5, the pressure on the pressurized slurry containing resin particles obtained at the cooling step S4 is reduced to a level at which no bubbling (generation of bubbles) is caused. The slurry being led from the cooling step S4 to the depressurizing step S5 is pressurized at around 5 MPa to 80 MPa. It is preferred that the depressurization be gradually carried out in a stepwise manner.

For the depressurizing operation, it is preferable to use a multistage depressurization apparatus stated in WO03/059497. The multistage depressurization apparatus is composed of an inlet passage for leading pressurized slurry containing resin particles into the multistage depressurization apparatus, an outlet passage in communication with the inlet passage, for discharging the depressurized slurry containing resin particles to outside of the multistage depressurization apparatus, and a multistage depressurization section disposed between the inlet passage and the outlet passage, on which two or more depressurization members are coupled via coupling members.

For example, between a part designed for the cooling step S4 and a part designed for the depressurizing step S5 is provided a pressure-resistant pipe on which a supply pump and a supply valve are provided, whereby the pressurized slurry containing resin particles obtained at the cooling step S4 is transferred to the part designed for the depressurization step S5. The slurry is thus led into the inlet passage of the multistage depressurization apparatus.

The depressurization member used for the multistage depressurization section in the multistage depressurization apparatus includes a pipe-shaped member, for example. The coupling member includes a ring-shaped seal, for example. The multistage depressurization section is configured by coupling a plurality of the pipe-shaped members having different inner diameters on each other by the ring-shaped seals. For example, two to four pipe-shaped members having the same inner diameters are coupled on each other from the inlet passage toward the outlet passage. On these pipe-shaped members is then coupled one pipe-shaped member having an inner diameter which is about twice as large as the inner diameter of these pipe-shaped members. Furthermore, on those pipe-shaped members are coupled about one to three pipe-shaped members having an inner diameter which is about 5% to 20% smaller than the inner diameter of the one pipe-shaped member. By so doing, the slurry containing toner particles, which flows inside the pipe-shaped members is gradually depressurized to a final pressure level at which no bubbling is caused, preferably to a level of air pressure.

A heat exchanging section using a cooling medium or heating medium may be disposed around the multistage depressurization section so that cooling or heating is conducted in accordance with a level of pressure imparted to the slurry containing resin particles.

The slurry containing resin particles, which is depressurized inside the multistage depressurization apparatus is discharged from the outlet passage to outside of the multistage depressurization apparatus.

The number of the multistage depressurization apparatuses being disposed may be one or plural.

The slurry containing diameter-reduced resin particles is thus obtained. The slurry can be used as it is in the toner manufacturing process expressed with (B). Further, diameter-reduced resin particles isolated from the slurry may be newly made into slurry. For the isolation of the resin particles from the slurry, a commonly-used separating device such as a filtration device and a centrifuge is used.

Note that, in the above granulating method, the steps through step S1 to step S5 may be carried out only one time, or alternatively, the steps through step S3 to step S5 may be repeated after one-time implementation of the steps through step S1 to step S5. In a case where the resin particles contain only binder resin, those conditions described above may be appropriately changed to thereby obtain resin particles having a particle diameter of 30 nm to 1000 nm, preferably 30 nm to 200 nm. In a case where the resin particles contain, for example, a releasing agent (wax) together with the binder resin, resin particles having a particle diameter of 30 nm to 1000 nm, preferably 150 nm to 500 nm are obtained.

(B) Toner Manufacturing Process

In the present process, a toner is manufactured in such a manner that the slurry containing resin particles and particles of toner raw material not contained in the resin particles are mixed with each other to be coagulated, and a thus-obtained coagulated product is heated. The process includes, for example, an admixture preparing step, a coagulated product forming step, a particle forming step, and a cleaning step.

[Admixture Preparing Step]

At the admixture preparing step, the slurry containing resin particles and the particles of toner raw material not contained in the resin particles are mixed with each other. For example, in a case where the resin particles contain only binder resin, the toner raw material not contained in the resin particles includes a colorant, a releasing agent (wax), and a charge control agent. Further, in a case where the resin particles include binder resin and releasing agent (wax), the toner raw material not contained in the resin particles includes a colorant and a charge control agent.

The mixing of the slurry containing resin particles and the other toner raw materials is conducted by use of a commonly-used mixing apparatus such as batch- or continuous-type emulsifying machine and dispersing machine. The emulsifying machine and the dispersing machine may be provided with a heating section for heating an admixture of the slurry containing resin particles and the toner raw materials (hereinafter referred to simply as "toner raw material admixture"), a stirring section and/or a rotating section which can give a shearing force to the toner raw material admixture, a mixing tank having a heat-retaining section, and the like component. Specific examples of the emulsifying machine and the dispersing machine include: a batch-type emulsifying machine such as Ultra Turrax (trade name) manufactured by IKA Japan K.K., Polytron Homogenizer (trade name) manufactured by Kinematica Co., and T.K. Autohomomixer (trade name) manufactured by Tokushu Kikai Kogyo K.K.; a continuous-type emulsifying machine such as Ebara Milder (trade name) manufactured by Ebara Seisakusho Co.), T.K. Pipeline Homomixer (trade name) manufactured by Tokushu Kikai Kogyo K.K., T.K. Homomic Line Flow (trade name) manufactured by Tokushu Kikai Kogyo K.K., Filmix (trade name) manufactured by Tokushu Kikai Kogyo K.K., Colloid Mill (trade name) manufactured by Shinko Pantec Co., Ltd., Slusher (trade name) manufactured by Mitsui Miike Kakoki Co., Ltd., Trigonal Wet Grinder (trade name) manufactured by Mitsui Miike Kakoki Co., Ltd., Cavitron (trade name) manufactured by Eurotec, Ltd., and Fine Flow Mill (trade name) manufactured by Taiheiyo Kiko Co., Ltd.; Clearmix (trade name) manufactured by M Technique Co., Ltd.; and Filmix (trade name) manufactured by Tokushu Kikai Kogyo K.K.

The mixing of the slurry of resin particles and the other toner components is conducted preferably at a room temperature by use of the emulsifying machine, the dispersing machine, and the mixer, and terminated after one to five hours. The admixture of toner raw materials thus obtained is then brought to the next coagulated product forming step.

[Coagulated Product Forming Step]

At the coagulated product forming step, a coagulant is added to the toner raw material admixture so that slurry containing a toner coagulated product is obtained. The coagulant may be added without stirring but preferably is added under stirring. As the coagulant, it is possible to use heretofore known coagulants, among which a water-soluble polyvalent metal compound is preferable. Examples of the water-soluble polyvalent metal compound include: polyvalent metal halides such as calcium chloride, barium chloride, magnesium chloride, zinc chloride, and aluminum chloride; polyvalent metal salts such as calcium nitrate, aluminum sulfate, and magnesium sulfate; and inorganic metal salt copolymers such as polyaluminum chloride, polyaluminum hydroxide, and calcium polysulfide. Among these ingredients, polyvalent metal salts are preferable, and particularly preferable are divalent or trivalent metal sulfates such as magnesium sulfate and aluminum sulfate. A usage of the water-soluble polyvalent metal compound is not limited to a particular level and may be selected as appropriate from a wide range according to a final particle diameter of toner particle in view of types of binder resin and the other toner components, a particle diameter of the resin particle, and the like element. A usage of the water-soluble polyvalent metal compound may be preferably set to be around 0.1 to 10 parts by weight based on 100 parts by weight of the resin particles.

[Particle Forming Step]

At the particle forming step, the slurry containing the toner coagulated product obtained at the coagulated product forming step is heated so that toner particles are obtained. A heating temperature is not limited to a particular level and preferably around the glass transition temperature of the binder resin constituting the resin particles. By appropriately adjusting the heating temperature and the heating time, it is possible to adjust a particle diameter of the toner particles being obtained.

[Cleaning Step]

At the cleaning step, the toner particles are isolated from the slurry containing toner particles obtained at the particle forming step, and subjected to cleaning by use of pure water, followed by drying. The toner particles of the invention are thus obtained. The toner particles from the slurry are isolated by use of a commonly-used separating device such as a filtration device and a centrifuge. An electric conductivity of the pure water used for the cleaning is preferably 20 μS/cm or less. The pure water thus described can be obtained by a heretofore known method including an activated carbon method, an ion exchange method, a distillation method, and a reverse osmosis method. Further, a water temperature of the pure water is preferably 10° C. to 80° C. The cleaning may be carried out until the electric conductivity of washing (water used for the cleaning of the toner particles) reaches 50 μS/cm or less. After completion of the cleaning, the toner particles are isolated from the washing, and then dried so that a toner of the invention is obtained.

The toner of the invention is formed of toner particles which have a reduced particle diameter of around 3.5 μm to 6.5 μm and exhibit a narrow particle size distribution. The toner of the invention thus has an advantage of being excellent in not only image reproducibility but also transparency, low-temperature fixing property, and the like property.

The toner of the invention may be subjected to surface modification by adding an external additive thereto. As the external additive, heretofore known ingredients can be used, including silica, titanium oxide, silicone resin, and silica and titanium oxide which are surface-treated with a silane coupling agent. Furthermore, a preferable usage of the external additive is 1 to 10 parts by weight based on 100 parts by weight of the toner.

The toner of the invention can be used in a form of either one-component developer and two-component developer. In a case of being used in a form of one-component developer, only toner is used without use of carriers while a blade and a fur brush are used to subject a developing sleeve to frictional electrification so that the toner is attached onto the sleeve, thereby conveying the toner to perform image formation.

Further, in a case of being used in form of two-component developer, the toner is used together with a carrier. As the carrier, heretofore known ingredients can be used, including single or complex ferrite composed of iron, copper, zinc, nickel, cobalt, manganese, and chromium, and carrier core particles of which surfaces are covered with a covering substance. As the covering substance, heretofore known ingredients can be used, including polytetrafluoroethylene, a monochloro-trifluoroethylene copolymer, polyvinylidene-fluoride, silicone resin, polyester resin, a metal compound of di-tert-butylsalicylic acid, styrene resin, acrylic resin, polyacid, polyvinyl butyral, nigrosine, aminoacrylate resin, basic dyes or lakes thereof, fine silica powder, and fine alumina powder, which are preferably selected according to the toner components. Further, the covering substances may be used each alone or two or more of the substances may be used in combination. An average particle diameter of the carrier is preferably 10 μm to 100 μm, more preferably 20 μm to 50 μm.

EXAMPLES

Hereinafter, the invention will be described more in detail with reference to examples.

Example 1

There were provided 92.5 parts by weight of polyester (having a weight-average molecular weight of 20,000, Mw/Mn of 24, and a softening temperature of 120° C.), 6 parts by weight of copper phthalocyanine blue, and 1.5 parts by weight of a charge control agent: TRH (trade name) manufactured by Hodogaya Chemical Co., Ltd. These constituent components were melt-kneaded by using a twin-screw extruder: PCM-30 (trade name) manufactured by Ikegai Co., Ltd. under cylinder setting temperature of 145° C. and barrel rotational speed of 300 rpm to prepare a melt-kneaded product of binder resin. The melt-kneaded product was then cooled down to a room temperature, thereafter being coarsely pulverized by a cutter mill: VM-16 (trade name) manufactured by Orient Co., Ltd. to prepare binder resin coarse particles having a particle diameter of 100 μm to 500 μm.

Next, 94 parts by weight of the melt-kneaded coarse particles obtained as described above and 20 parts by weight of an aqueous solution containing 30% by weight of a dispersion stabilizer: Joncryl 70 (trade name) manufactured by Johnson Polymer Corporation were mixed to prepare water-based slurry containing melt-kneaded coarse particles. The water-based slurry was made to pass under pressure of 168 MPa through a nozzle having an inner diameter of 0.45 mm, whereby the pretreatment was applied so that a particle diameter of the melt-kneaded coarse particles contained in the water-based slurry was adjusted to be 100 μm or less.

The water-based slurry containing melt-kneaded coarse particles obtained as described above was pressurized at 210 MPa and heated to 110° C. inside a pressure-resistant airtight container, and then supplied from a pressure-resistant pipe mounted on the pressure-resistant airtight container to a pressure-resistant nozzle mounted on an outlet of the pressure-resistant pipe. The pressure-resistant nozzle is a pressure-resistant multiple nozzle having a length of 0.5 cm, which is configured so that two liquid flowing holes having a hole diameter of 0.143 mm are substantially parallel to each other in a longitudinal direction of the nozzle. At an inlet of the nozzle, a temperature of the water-based slurry was 110° C., and pressure imparted to the water-based slurry was 210 MPa. At an outlet of the nozzle, a temperature of the water-based slurry was 120° C., and pressure imparted to the water-based slurry was 42 MPa. The water-based slurry discharged from the pressure-resistant nozzle was led into a corrugated tube-type cooling machine connected to the outlet of the pressure-resistant nozzle, where cooling was carried out. At an outlet of the cooling machine, a temperature of the water-based slurry was 30° C., and pressure imparted to the water-based slurry was 35 MPa. The water-based slurry discharged from the outlet of the cooling machine was led into the multistage depressurization apparatus connected to the outlet of the cooling machine, where depressurization was conducted. The water-based slurry discharged from the multistage depressurization apparatus contained resin particles having a particle diameter of 30 nm to 150 nm.

Next, 480 parts by weight of the obtained water-based slurry, which amount is equivalent to 96 parts by weight of solid matter (resin particles), and 4 parts by weight of polyester wax particles were mixed with each other by use of a mixer: a Henschel mixer (trade name) manufactured by Mitsui Mining Co. The toner raw material admixture was thus prepared. The toner raw material admixture was stirred at 2,000 rpm inside a homogenizer while drops of an aqueous solution containing 0.1% by weight of magnesium sulfate were added little by little to the admixture, followed by one-hour stirring of the admixture. Then, generation of a toner coagulated product was visually recognized. Water-based slurry containing the toner coagulated product was thus prepared. The water-based slurry containing the toner coagulated product was stirred for two hours at a temperature of 75° C. to thereby form, in the water-based slurry, toner particles which were uniform in particle diameter and shape. The toner particles isolated from the slurry by filtration was cleaned three times with pure water (0.5 μS/cm) and then dried in a vacuum drier, thus manufacturing the toner of the invention, of which particle diameter fell in a range of 3.5 μm to 6.5 μm. Note that the pure water was prepared from tap water by using a super pure water preparation apparatus: Ultra Pure Water System CPW-102 (trade name) manufactured by ADVANTEC Co. The conductivity of water was measured by using a Lacom Tester: EC-PHCON 10 (trade name) manufactured by Iuchi Seieido Co., Ltd. Further, a particle diameter of the toner was obtained through observation of 100 microscope fields, at every one microscope field whereof a maximum diameter and a minimum diameter of the toner were obtained at 1000-fold magnification by using an electron scanning microscope manufactured by Keyence Corporation.

Example 2

There were provided 92.5 parts by weight of polyester (having a weight-average molecular weight of 20,000, Mw/Mn of 24, and a softening temperature of 120° C.), 5 parts by weight of polyester wax (serving as a releasing agent and having a melting temperature of 85° C.), 6 parts by weight of copper phthalocyanine blue, and 1.5 parts by weight of a charge control agent: TRH (trade name) manufactured by Hodogaya Chemical Co., Ltd. These constituent components were melt-kneaded by using a twin-screw extruder: PCM-30 (trade name) manufactured by Ikegai Co., Ltd. under cylinder setting temperature of 145° C. and barrel rotational speed of 300 rpm to prepare a melt-kneaded product of binder resin. The melt-kneaded product was then cooled down to a room temperature, thereafter being coarsely pulverized by a cutter mill: VM-16 (trade name) manufactured by Orient Co., Ltd. to prepare binder resin coarse particles. The following operation was carried out as in the case of Example 1, thus preparing water-based slurry containing resin particles of which particle diameter fell in a range of 200 nm to 450 nm.

Next, 500 parts by weight of the obtained water-based slurry, which amount is equivalent to 100 parts by weight of solid matter (resin particles), was used as the toner raw material admixture. The toner raw material admixture was stirred at 2,000 rpm inside a homogenizer while drops of an aqueous solution containing 0.1% by weight of magnesium sulfate were added little by little to the admixture, followed by one-hour stirring of the admixture. Then, generation of a toner coagulated product was visually recognized. Water-based slurry containing the toner coagulated product was thus prepared. The water-based slurry containing the toner coagulated product was stirred for two hours at a temperature of 75° C. to thereby form, in the water-based slurry, toner particles which were uniform in particle diameter and shape. The toner particles isolated from the slurry by filtration was cleaned three times with pure water (0.5 μS/cm) and then dried in a vacuum drier, thus manufacturing the toner of the invention, of which particle diameter fell in a range of 3.5 μm to 6.5 μm.

The following performance tests were conducted on the toner of the invention obtained as described above.

[Image Density]

The obtained toner was put in a developer tank of developing device of testing image forming apparatus to thereby form an unfixed test image including a solid image part, such that a toner amount attached to a sheet designed only for full color: PP106A4C (trade name) manufactured by Sharp Corporation (hereinafter referred to simply as "recording sheet") was 0.6 mg/cm$^2$. As the testing image forming apparatus, there was used a commercially available image forming apparatus: AR-C150 digital full color multifunction printer (trade name) manufactured by Sharp Corporation, of which fixing device was removed as a result of remodeling of a developing device into a device for non-magnetic one-component developer.

The unfixed image formed was fixed by an external fixing machine. An image thus obtained was used as an evaluation image. As the external fixing machine, there was used an oil-less fixing device which was taken out from a commercially available image forming apparatus: AR-C160 digital full color multifunction printer (trade name) manufactured by Sharp Corporation. The oil-less fixing device section means a fixing device which performs fixing without applying a releasing agent onto a heating roller.

An optical density of the solid image part in the evaluation image thus obtained was measured. The measurement was conducted by use of a spectral calorimetric densitometer: X-Rite 938 (trade name) manufactured by Nippon Heiban Insatsukizai Co. All optical densities measured on 100 samples were 1.40 or more. It was thus turned out that the image density was very high.

[Fogging Level]

At the outset, whiteness defined by JIS P8148 on an A4-sized recording sheet (PP106A4C) defined by JIS P0138 was measured by use of a whiteness checker: Z-Σ90 Color Measuring System (trade name) manufactured by Nippon Denshoku Industries Co., Ltd. The obtained value was defined as a first measurement value W1.

The toner of the invention was put in a developing tank of developing device of commercially available digital multifunction printer: AR-620 (trade name) manufactured by Sharp Corporation, to thereby form an evaluation image containing a while circle part having a diameter of 55 mm and a black solid part surrounding the while circle part onto three recording sheets of which whiteness had been measured. By use of the above-described whiteness checker, whiteness of the white circle part on each of the evaluation images was measured, and an average thereof was then calculated. The obtained value was defined as a second measurement value W2. A fogging density W(%) was calculated based on the following formula using the first measurement value W1 and the second measurement value W2:

$$W(\%)=[(W1-W2)/W1]\times 100$$

All the fogging densities W calculated on 100 samples were 1.0% or less. It was thus obvious that fogging was hard to be caused.

[Transferring Property]

The toner of the invention was put in a developer tank of developing device of commercially available digital multifunction printer: AR-620 (trade name) manufactured by Sharp Corporation, to thereby make a copy of a predetermined chart containing a solid image part onto a recording sheet (PP106A4C). A weight Mp (mg/cm$^2$) of transferred toner (hereinafter referred to as "transferred toner amount") in the solid image part per section area of the recording sheet was then measured. Moreover, a weight Md (mg/cm$^2$) of remaining toner (hereinafter referred to as "remaining toner amount") per section area in a part of a photoreceptor used for making the copy, where the solid image part had been formed, was measured. The weight of toner was measured under circumstances of a temperature of 20° C. and a relative humidity of 50% RH. A transfer ratio T(%) was calculated based on the following formula using the measured transferred toner amount Mp and remaining toner amount Md:

$$T(\%)=[Mp/(Md+Mp)]\times 100$$

All the transfer ratios T calculated on 100 samples were 90% or more. It was thus turned out that the toner had a very excellent transfer ratio.

[Fixing Property Rubbing Test]

The unfixed image formed on a sheet of 75 g/m$^2$ was fixed thereon by use of an external fixing machine of oil-less type (of heat-roller system, characterized by 40 mm in diameter of a fixing roller, 35 mm in diameter of a pressure roller, 205 mm/sec of processing speed, 5 mm in a nip width, a temperature of the pressure roller of 135° C., and a fixing temperature of 150° C.). There was then conducted a rubbing test such that a 1 kg-loaded eraser was made to move back and forth three times on a surface of the fixed image. A change between an image density before the test and an image density after the test was measured by use of the Macbeth reflection densitometer to obtain a residual ratio of the image. Seven measurements of different densities were used to create a graph from which a minimum residual ratio was evaluated. All the minimum residual ratios obtained from 100 samples were 90% or more. It was thus turned out that the toner had a very excellent transferring and fixing property.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner comprising the steps of:

coagulating resin particles containing at least binder resin, which have a particle diameter of 1 μm or less and are obtained from slurry containing coarse particles of binder resin by a high pressure homogenizer method, and particles of toner raw material not contained in the resin particles; and heating a resultant coagulated product, wherein the high pressure homogenizer method comprises:

a pulverizing step for obtaining heated and pressurized slurry containing resin particles having a particle diameter of 1 μm or less by passing slurry containing coarse particles of binder resin through a pressure-resistant nozzle under heat and pressure and pulverizing the coarse particles of binder resin;

a cooling step for cooling down the slurry obtained at the pulverizing step; and a depressurizing step for gradually depressurizing the slurry cooled down at the cooling step, to a pressure level at which no bubbling is caused, at the depressurizing step, a pressure on the slurry is gradually reduced to a level at which no bubbling is caused by passing the pressurized slurry containing resin particles, which is cooled down at the cooling step, through a multistage depressurization apparatus for performing stepwise depressurization.

2. The method of claim 1, wherein a particle diameter of the resin particles containing at least binder resin falls in a range of 30 nm to 1000 nm.

3. The method of claim 1, wherein the slurry containing coarse particles of binder resin is slurry prepared by dispersing the coarse particles of binder resin into water.

4. The method of claim 1, wherein the slurry containing coarse particles of binder resin is slurry prepared by dispersing the coarse particles of binder resin into an admixture of water and a dispersion stabilizer.

5. The method of claim 1, wherein the slurry is pressurized at a pressure in a range from 50 MPa to 250 MPa, and heated to 50° C. or more at the pulverizing step.

6. The method of claim 1, wherein the slurry is pressurized at a pressure in a range from 50 MPa to 250 MPa, and heated to 90° C. or more at the pulverizing step.

7. The method of claim 1, wherein the pressure-resistant nozzle is a multiple nozzle.

8. The method of claim 1, wherein the multistage depressurization apparatus used at the depressurizing step comprises:

an inlet passage for leading the pressurized slurry containing resin particles into the depressurization apparatus;

an outlet passage in communication with the inlet passage, for discharging the slurry containing resin particles to outside of the depressurization apparatus; and a multistage depressurization section for performing stepwise depressurization, the multistage depressurization section being disposed between the inlet passage and the outlet passage and being composed of two or more depressurization members coupled via coupling members.

9. The method of claim 1, wherein the binder resin is polyester.

10. A toner manufactured by the method of manufacturing a toner of claim 1.

* * * * *